United States Patent [19]

Trubiano

[11] Patent Number: 4,629,086

[45] Date of Patent: Dec. 16, 1986

[54] COLLAPSIBLE AND STACKABLE MATERIAL HANDLING CONTAINER

[75] Inventor: Antoine Trubiano, Pointe aux Trembles, Canada

[73] Assignee: Cari-All Inc., Montreal East, Canada

[21] Appl. No.: 782,891

[22] Filed: Oct. 2, 1985

[51] Int. Cl.[4] ..... B65D 7/20

[52] U.S. Cl. ..... 220/7; 220/6; 220/19

[58] Field of Search ..... 220/7, 6, 1.5, 19; 206/511, 512, 513, 507

[56] References Cited

U.S. PATENT DOCUMENTS

| | | | |
|---|---|---|---|
| 2,735,568 | 2/1956 | Bitney | 220/6 |
| 2,783,911 | 3/1957 | Bussing | 220/7 |
| 2,842,232 | 7/1958 | Walsh | 220/19 X |
| 3,372,829 | 3/1968 | Averill | 220/19 X |
| 3,442,231 | 5/1969 | Jurasek | 206/513 X |
| 3,907,150 | 9/1975 | Jurasek | 220/19 |
| 4,015,743 | 4/1977 | Beretta | 220/19 |
| 4,050,606 | 9/1977 | Jurasek | 220/7 |
| 4,157,852 | 6/1979 | Zacky | 220/84 X |

*Primary Examiner*—Steven M. Pollard

*Attorney, Agent, or Firm*—Burns, Doane, Swecker & Mathis

[57] ABSTRACT

A collapsible and stackable material handling container comprising a collapsible basket defined by a bottom support wall, a rear wall hinged along a bottom edge to a rear edge of the bottom wall, a pair of side walls each hinged at a vertical rear edge to a respective one of opposed vertical edges of the rear wall, and a front wall hinged along a bottom edge to a front edge of the bottom wall. The improvement comprises a support frame formed with the bottom wall for supporting the basket and a load positionable therein elevated from a support surface. The support frame is a rectangular frame defined by opposed pairs of parallel outer tubular members and intermediate tubular members extending between the outer tubular members, all having sloped faces, and secured thereto to form a structural frame. A leg member is secured to a respective corner of the support frame and defines a hook flange. A corner plate is secured to the leg member and has a hook flange receiving channel in a top edge thereof.

9 Claims, 9 Drawing Figures

10
11
12
13
14
15
16
17
17'
17''
18
19
20
21
22

COLLAPSIBLE AND STACKABLE MATERIAL HANDLING CONTAINER

BACKGROUND OF INVENTION (a) Field of the Invention

The present invention relates to an improved collapsible and stackable material handling container of the type wherein the basket walls are collapsible upon the bottom wall of the basket with the container being stackable one on top of each other when the baskets are so collapsed. Particularly, the present invention relates to improvements in the support frame and leg members of the container.

(b) Description of Prior Art

The present invention is an improvement of my Canadian Pat. No. 1,021,274 issued Nov. 22, 1977 relating to such material handling container. In that patent, I disclose a container wherein the bottom wall and leg members are constructed entirely from welded wire members. To add rigidity to the container, it is known to utilize hollow channel members to construct a support frame on which the collapsible basket is secured. Furthermore, the leg members may be constructed from heavy gauge steel sheet material. Such support frame and leg members are, for example, disclosed in Canadian Pat. No. 905,314 issued July 18, 1984 to Stanley J. Jurasek and Canadian Pat. No. 912,997 issued Oct. 24, 1972 to Allan M. Buehler. However, a disadvantage of such support frames is that the channels present top flat surfaces to which are usually secured a wire mesh defining the basket bottom wall. Accordingly, a larger number of cavities are formed between the wire mesh and the top surface of these channel members and these collect all sorts of foreign matter, making the basket difficult to clean and inhibiting bacterial growth. Another disadvantage of such containers is that they are often damaged during handling by fork-lift trucks. It is common when turning such baskets to reorient them on the floor, to push the frame with the forks of the truck and often the fork will slip on the frame causing damage to the walls of the container or the frame itself.

A still further disadvantage of these containers is that when the walls thereof are folded on the bottom wall, the handle members which are usually provided on the front wall (see my Canadian Pat. No. 1,021,274) often become damaged or cause damage to other parts of the container side walls due to improper positioning of the handle members.

A still further disadvantage of such containers is that they are difficult to assemble and very little protection is provided to the container walls folded on the bottom wall when the container is in its collapsed position and not in use.

SUMMARY OF INVENTION

It is a feature of the present invention to provide a collapsible and stackable material handling container which substantially overcomes all of the above-mentioned disadvantages of the prior art.

It is a further feature of the present invention to provide a collapsible and stackable material handling container having a support frame of novel construction whereby the bottom wall and the frame of the container are easy to clean and do not cause the accumulation of foreign matter.

Another feature of the present invention is to provide a collapsible and stackable material handling container wherein the leg members are of improved construction and provide protection to the container when in its used or non-used condition.

According to the above features, from a broad aspect, the present invention provides a collapsible and stackable material handling container comprising a collapsible basket defined by a bottom support wall, a rear wall hinged along a bottom edge to a rear edge of the bottom wall, a pair of side walls each hinged at a vertical rear edge to a respective one of opposed vertical edges of the rear wall, and a front wall hinged along a bottom edge to a front edge of the bottom wall. The improvement comprises a support frame formed with the bottom wall for supporting the basket and a load positionable therein elevated from a support surface. The support frame is a rectangular frame defined by opposed pairs of parallel outer tubular members and intermediate tubular members extending between the outer tubular members, all having sloped faces, and secured thereto to form a structural frame. A leg member is secured to a respective corner of the support frame and defines a hook flange. A corner plate is secured to the leg member and has a hook flange receiving channel in a top edge thereof.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figures 1A, 1B, 1C:
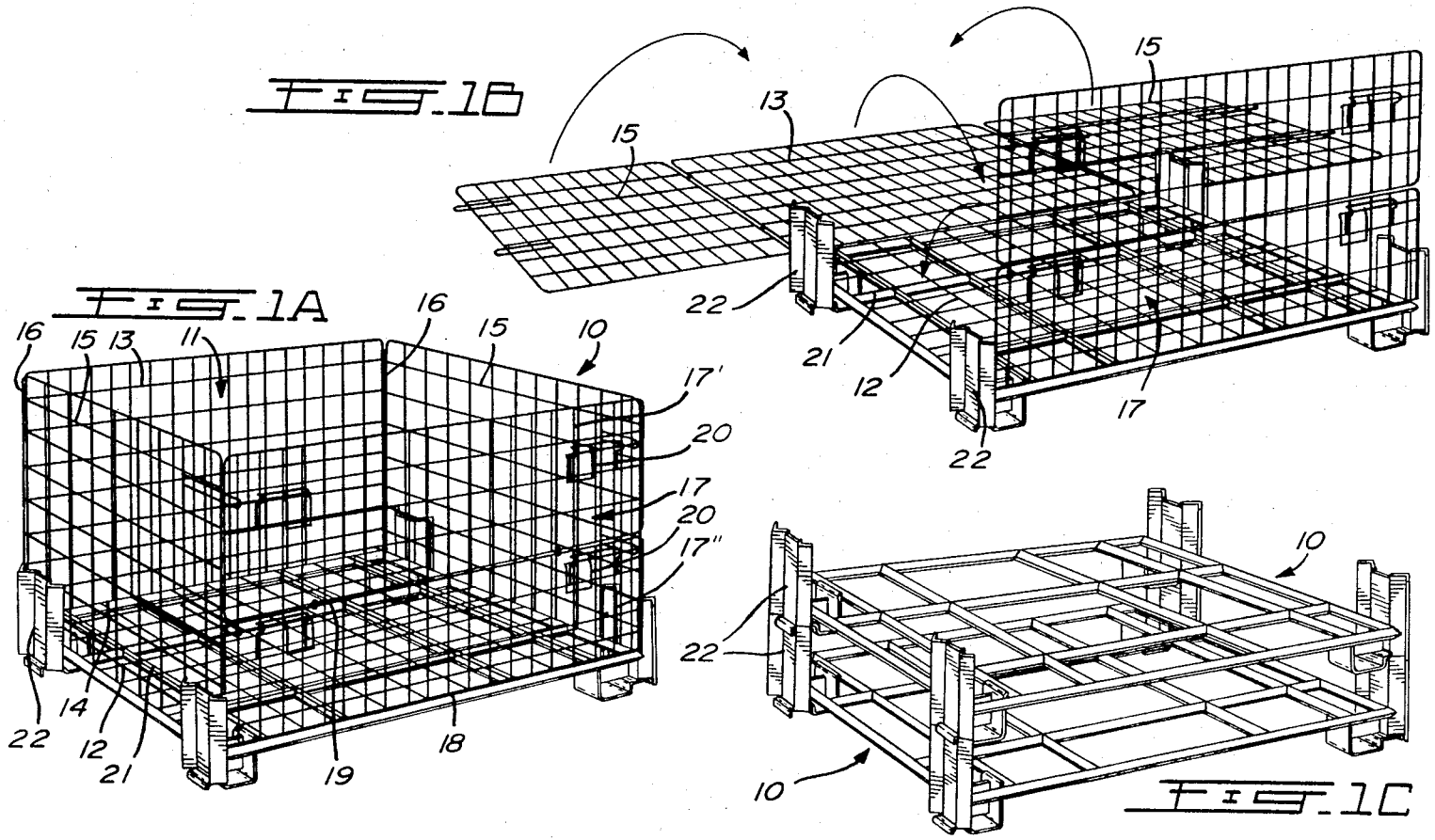
FIGS. 1*a*–1*c* are perspective illustrations of the collapsible and stackable material handling container illustrating the type of container and its basic construction.

Referring now to the drawings, and more particularly to FIGS. 1*a*–1*c*, there is illustrated generally at 10, the collapsible and stackable material handling container of the present invention. The container comprises a collapsible basket 11 which is defined by a bottom support wall 12 and a rear wall 13 hinged along a bottom edge to a rear edge 14 of the bottom wall 12. A pair of side walls 15 are each hinged at a vertical rear edge 16 of the rear wall 13. A front wall 17 is hinged along a bottom edge to a front edge 18 of the bottom wall 12. As herein shown, the front wall 17 is constructed in two sections 17' and 17'' superimposed one on top of each other and hinged together by a hinge connection 19. Each of the wall sections 17' and 17'' are provided with sliding lock pins 20 to secure the front wall sections to the side walls 15.

The bottom wall, rear wall, side walls and front wall of the container are all constructed of steel wire meshing. The bottom wall 12 is secured to a support frame 21 with the wires of the bottom wall 12 being welded to the frame 21. Leg members 22 are secured to the corner of the frame 21 to support the container above a floor surface. FIG. 1*b* illustrates the manner in which the walls are collapsed onto the bottom wall when the container is in its storage condition. As can be seen, the front wall 17 is firstly folded over the bottom wall 12. The side walls 15 are then folded over the rear wall 13 and this folded assembly is then folded back onto the front wall. These walls are folded outwardly of the leg members 22 which provide passage for the walls to fold them and collapse them one on top of each other. Once the container is in its collapsed position, it can be stored one on top of each other as illustrated in FIG. 1*c*.

Figure 2:
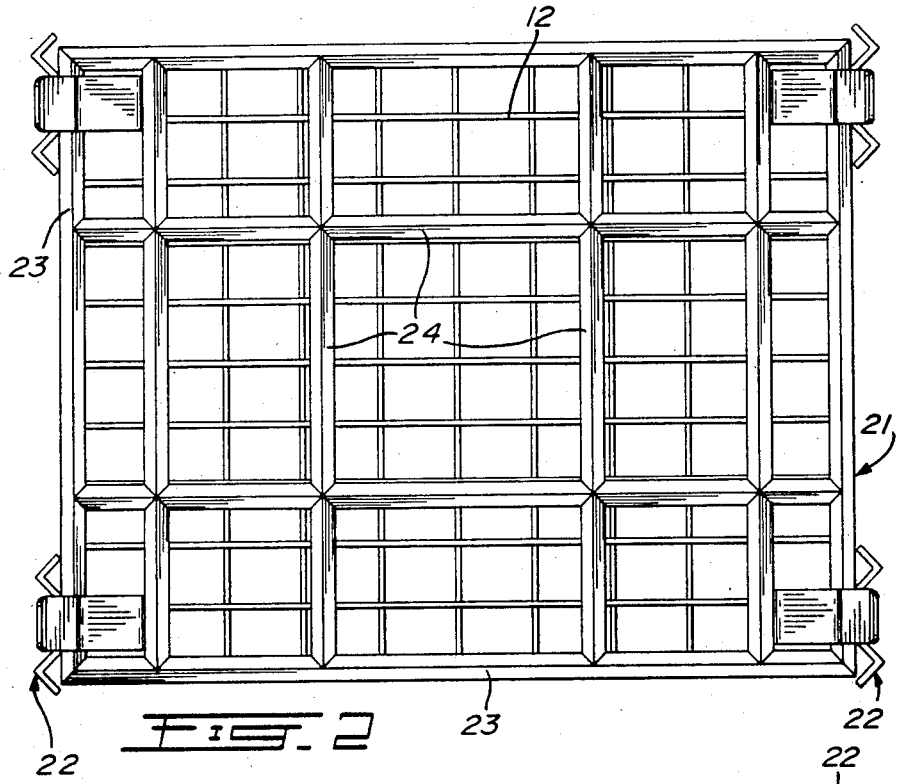
FIG. 2 is a bottom view of the container of the present invention illustrating the construction of the support frame.
Figure 3:
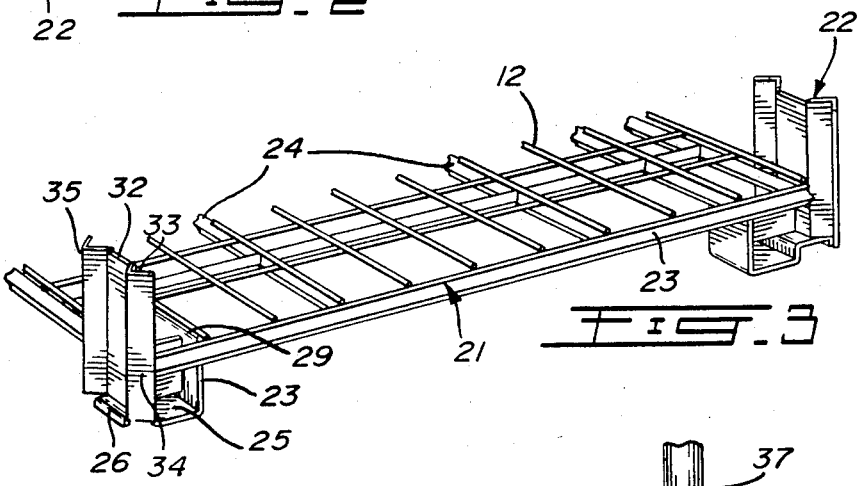
FIG. 3 is a perspective fragmented end view of the container illustrating the support frame and leg members.
Figure 4:
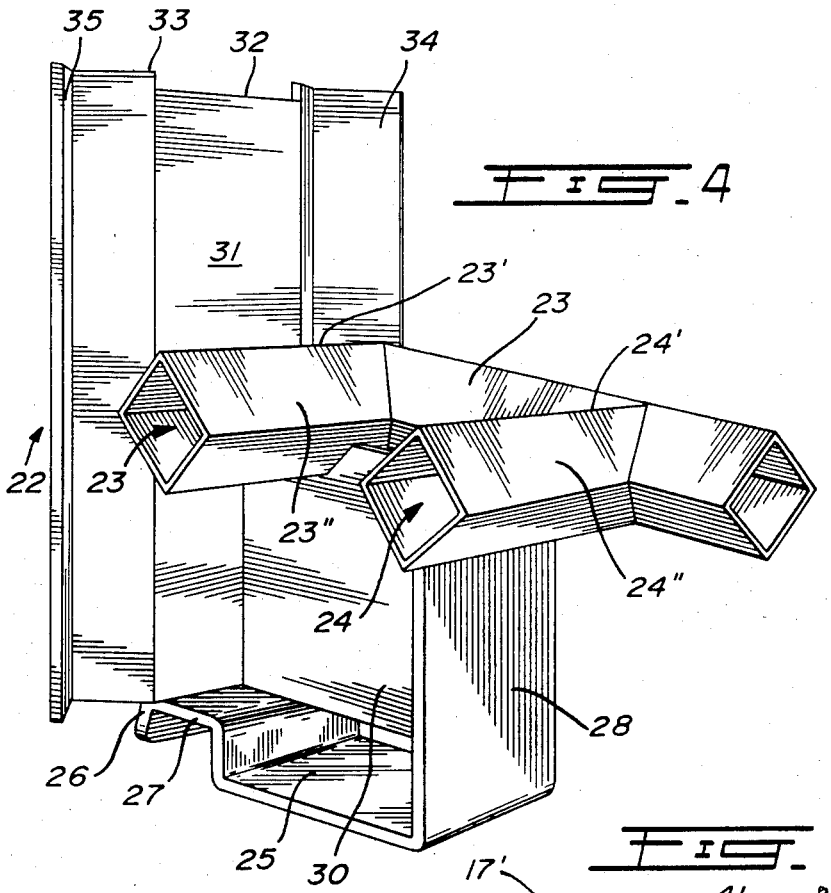
FIG. 4 is a perspective view of the leg member.

Referring now additionally to FIGS. 2 to 4, there is illustrated more clearly the construction of the support frame 21. As herein shown, the support frame is of generally rectangular configuration and is defined by opposed parallel outer tubular members 23 and intermediate tubular members 24 all welded together at right angles. These tubular members are steel tubes of diamond-shape cross-section, as better illustrated in FIG. 4, with the apex 23' and 24' thereof being oriented vertically in the direction of the bottom support wall 12 to form outwardly sloping surfaces 23'' and 24'' extending in the vertical plane. Thus, it can be appreciated that no foreign material or food material can be lodged between the wire meshing of the bottom wall 12 and the upper surface of these tubular members as they are slanted or sloped away from the vertical plane. Also, the entire bottom wall and container can be easily steam-cleaned without having to scrub in cavities which are usually formed under the wire meshing and any flat surface thereunder.

FIGS. 3 and 4 better illustrate the construction of the leg members 22 which are secured to a respective corner of the support frame. As herein shown, each leg member is formed of a steel plate having a flat support surface portion 25 and a hook flange portion 26 formed integrally therewith. The hook flange portion 26 extends forwardly and above the plane of the support surface 25 and defines a nesting surfacte 27. A vertical securement flange 28 is also formed integral with the support surface portion 25 and extends rearwardly of this portion and has a bent flange end portion 29 which is welded to one of the intermediate tubular members 24. A transverse structural wall 30 is welded between the vertical securement flange 28 and a corner plate 31 which is of substantially rectangular configuration and welded vertically above the hook flange portion 26. The corner plate and the vertical securement flange are disposed substantially parallel to one another and held securely in this position by the transverse structural wall 30 welded thereto.

As shown, the structural wall 30 extends substantially mid-width of the vertical securement flange 28 and the corner plate 31. Also, an end one of the outer tubular members 23 is welded to the structural wall 30 and the corner plate 31. Thus, all the integers forming the leg member 22 are welded together in transverse planes to enhance the rigidity and strength of the leg member and corner plate 31 to resist shocks in all directions whereby the corner plate 31 provides improved protection to the container.

The corner plate 31 is provided with a hook flange receiving channel 32 in a top edge 33 thereof whereby to receive the nesting surface 37 of the hook flange 26 in captive engagement therewith preventing lateral shifting of stacked containers 10. The corner plate is also provided with guard means in the form of opposed vertical ribs 34 and 35 of V-shaped cross-section formed integral with plate 31 along opposed vertical edges thereof. These ribs extend vertically along the entire length of their respective edges and add structural rigidity to the plate 31 and protect the containers against the prongs of fork lift trucks. The outer rib 35 permits the forks of the lift truck to engage the front plate 31 and push the container over a surface whereby to reorient its direction.

Figure 7:
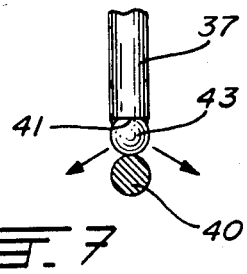
FIG. 7 is a perspective illustration showing the construction of the free ends of the side arms of a handle secured to the lock pin.
Figure 5:
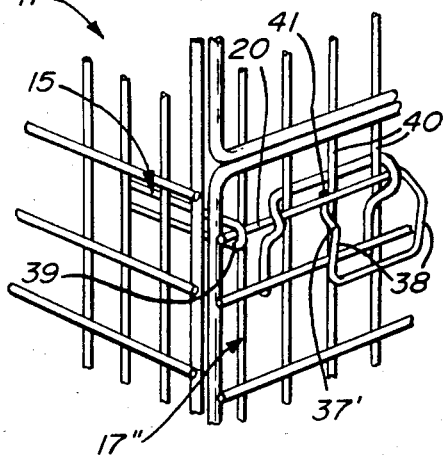
FIG. 5 is a fragmented perspective view showing the lock pin construction for locking the front wall to the side walls.
Figure 6:
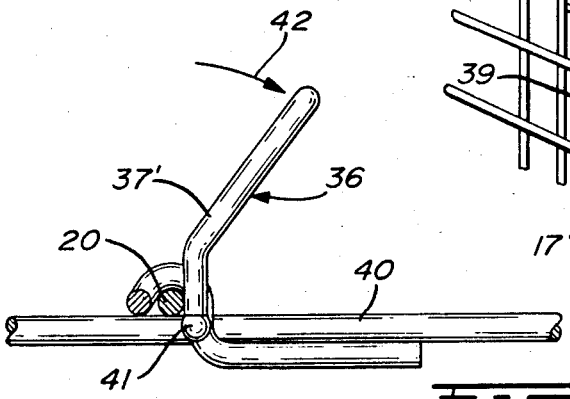
FIG. 6 is a side view, partly fragmented, showing the construction of the lock pin.

Referring now to FIGS. 5 to 7, there is shown a portion of the front wall illustrating the panels 17' and 17''. The sliding connecting lock pin 20 is comprised of a straight rod having a U-shaped handle member 36 formed integral therewith. The handle member defines a pair of side arms 37 having a bent end portion 38 extending behind the lock pin 20 with one arm 37' welded thereto. The construction and operation of such type handle member is clearly described in my aforementioned Canadian Pat. No. 1,021,274. The purpose of the handle member is to displace the pin axially and to lock it in position through the hook end 39 which extends from a respective front vertical edge of the side walls 15 and which are aligned to receive respective lock pins 20 therein to interconnect the side walls to the front wall and thus all the peripheral walls of the container. The side arms 37 of the handle lie in the plane of the wire rods 40 which forms the front wall of the panel 17''. The improvement of this handle member resides in that the free ends 41 of the side arm 37' is rounded to prevent this end from resting on some of the wire rods 40 when the side arms are displaced out of the plane of the wire rods 40, as illustrated in FIG. 6. If this end was flat, the handle 36 would be resting in the position as shown in FIG. 6 and when the rear wall is brought down on the front wall to collapse these walls one on top of each other, the weight of the rear wall and the side walls would be applied in the direction of arrow 42 and this load would be transferred to the weld connection between the lock pin 20 and the side arm 37' and the free ends of the side arms 37 thus causing damage in that region of the handle member. Also, the handle may be jammed in the position shown in FIG. 6 and prevent proper stacking. Thus, by having the free end rounded, the handle will not assume a position as shown in FIG. 6 but the free end of this arm will slip to either side of the wire rod 40 in the fashion as illustrated in FIG. 7. This rounded end is better achieved by welding a ball bearing 43 on the free end 41 of each of the side arms 37 and this eliminates the aforementioned problems.

It is within the ambit of the present invention to cover any obvious modifications of the preferred embodiment described herein, provided such modifications fall within the scope of the appended claims.

I claim:

1. A collapsible and stackable material handling container comprising a collapsible basket defined by a bottom support wall, a rear wall hinged along a bottom edge to a rear edge of said bottom wall, a pair of side walls each hinged at a vertical rear edge to a respective one of opposed vertical edges of said rear wall, and a front wall hinged along a bottom edge to a front edge of said bottom wall, the improvement comprising a support frame formed with said bottom wall for supporting said basket and a load positionable therein elevated from a support surface, said support frame having a rectangular frame defined by opposed pairs of parallel outer tubular members and intermediate tubular members extending between said outer tubular members all having sloped faces and secured thereto to form a structural frame, a leg member secured to a respective corner of said support frame and defining a hook flange, and a corner plate secured to said leg member and having a hook flange receiving channel in a top edge thereof, said corner plate having vertical structural ribs to strengthen the corner region of said container, said outer and intermediate tubular members being steel tubes of diamond-shape cross-section with an apex thereof oriented vertically in the direction of said bottom support wall to form outwardly sloping surfaces in the vertical plane, said bottom support wall being formed of transverse spaced-apart wire meshing welded to said support frame.

2. A container as claimed in claim 1 wherein said structural ribs are constituted by opposed vertical ribs formed integral with said corner plate and extending along opposed vertical edges thereof.

3. A container as claimed in claim 2 wherein said ribs are of V-shaped cross-section and extend outwardly of an outer face of said plate, said plates being disposed in a respective corner side edge portion of said bottom support wall.

4. A container as claimed in claim 1 wherein said leg member comprises a steel plate having a flat support surface portion, said hook flange being formed integral with said steel plate and extending forwardly and above said support surface portion and defining a nesting surface for said corner plate, a vertical securement flange formed integrally and extending rearwardly of said support surface portion and having a bent flange end portion for securement to one of said intermediate tubular members, and a transverse structural wall welded between said vertical securement flange and said corner plate with said vertical securement flange and corner plate disposed substantially parallel to one another.

5. A container as claimed in claim 4 wherein said structural wall extends substantially mid-width of said vertical securement flange and corner plate, an end one of said outer tubular members being welded to said structural wall and corner plate to constitute a structural leg member having multiplanar connections to enhance rigidity and strength.

6. A container as claimed in claim 1 wherein said hook flange receiving channel is an elongated cavity portion in said top edge of said corner plate and defining a flat horizontal support edge for receiving a portion of said hook flange thereon.

7. A container as claimed in claim 1 wherein said front wall is provided with at least one sliding connecting lock pin displaceably secured adjacent opposed vertical edges of said front wall, a hook extending from a respective front vertical edge of said side walls and aligned to receive a respective lock pin therein for interconnecting said container walls in an erected position, a U-shaped handle member having side arms formed integral with said pin to displace said pin axially and to lock it in position by means of said arms lying in the plane of wire rods forming said front wall, one of said side arms having a rounded free end to prevent said end from resting on some of said wire rods when said side arms are disposed out of said plane of said wire rods.

8. A container as claimed in claim 7 wherein a steel ball bearing is welded to said free end of said one of said side arms to constitute said rounded free end.

9. A container as claimed in claim 8 wherein all of said collapsible basket walls are formed of welded wire mesh, said rear wall, side walls and front wall being collapsible upon each other over said bottom wall and lying below a horizontal plane passing through said top edge of said corner plates.

* * * * *